US005253393A

United States Patent [19]

Levin

[11] Patent Number: 5,253,393

[45] Date of Patent: Oct. 19, 1993

[54] SPOTTER STRAP

[76] Inventor: Norman D. Levin, P.O. Box 1867, Pompano Beach, Fla. 33061

[21] Appl. No.: 810,492

[22] Filed: Dec. 19, 1991

[51] Int. Cl.[5] ..... A44B 21/00; A63B 69/00

[52] U.S. Cl. ..... 24/301; 24/300; 248/205.5; 482/90

[58] Field of Search ..... 24/301, 300, 302, 298, 24/905; 248/205.3, 205.5, 499; 482/90

[56] References Cited

U.S. PATENT DOCUMENTS

| | | | |
|---|---|---|---|
| 295,577 | 3/1884 | Nerney | 24/905 |
| 1,273,934 | 7/1918 | Horton | 24/301 |
| 2,145,142 | 1/1939 | Stout | 248/205.5 |
| 2,192,946 | 3/1940 | Towner | 24/301 |
| 2,909,356 | 10/1959 | Salick | 248/499 |
| 2,920,187 | 1/1960 | Barilla | 248/205.5 |
| 3,174,787 | 3/1965 | Kolman | 24/300 |
| 3,290,743 | 12/1966 | Hanson | 24/301 |
| 3,905,610 | 9/1975 | Dini | 24/302 |
| 4,167,259 | 9/1979 | Bury | 248/205.3 |
| 4,557,478 | 12/1985 | Levine | 482/90 |

FOREIGN PATENT DOCUMENTS

| | | | |
|---|---|---|---|
| 0480123 | 4/1953 | Italy | 248/499 |
| 0228762 | 2/1925 | United Kingdom | 248/205.5 |

*Primary Examiner*—Victor N. Sakran

*Attorney, Agent, or Firm*—Malin, Haley, DiMaggio & Crosby

[57] ABSTRACT

An apparatus for restricting the dynamic motion of a heavy bag suspended at one end for physical training purposes, said apparatus comprising a resilient strap portion releasably attached at one end to the lower end of the heavy bag by a resilient bonded cup, and releasably attached at the other end to the floor or other surface by a pair of hook members. Said hook members may be adapted for rotation such that said resilient strap portion may be free to rotate about the longitudinal axis thereof.

13 Claims, 2 Drawing Sheets

SPOTTER STRAP

BACKGROUND OF THE INVENTION

1. Field of the Invention

This invention relates generally to an apparatus for restricting the dynamic motion of a heavy bag suspended at one end for physical training purposes, and more particularly, to a spotter strap releasably secured to the bottom end of the heavy bag and extending to a releasable joint on the floor or equivalent surface.

2. Background

Heavy bags used for physical training to improve boxing ability are well known in the art. Typically, the heavy bag is suspended from a frame at its top end whereby it is permitted to swing freely back and forth. Because the bag has a relatively large mass, once it starts to swing under repeated punching loads by the user, inertia makes it difficult to prevent it from continuing to swing which may interfere with its intended use. Thus, it is desirable to provide a means whereby the user can anchor the bottom of the bag to either the floor or a part of the support frame such that the bag will be constrained from swinging.

SUMMARY OF THE INVENTION

The present invention provides a spotter strap apparatus for restricting the dynamic swinging motion of a heavy bag suspended from a frame for physical fitness purposes. The invention comprises a strap having a hook attachment at one end which is capable of being releasably attached to the bottom end of the heavy bag by a resilient bonded cup, and a hook attachment at the other end which may be releasably secured to a part of the mounting frame, or the floor surface.

The strap is preferably constructed from elastomeric material of sufficient resiliency so that it may be stretched somewhat to facilitate attachment to the bag and floor ends respectively. The strap may be fabricated with a cylindrical or rectangular body cross-section as dictated by the manufacturing process chosen. A flat strap having a rectangular cross-section is preferable, since it is easy to fabricate in an injection molded process. The strap incorporates divergent end sections which are thicker in cross-section than the body portion, to facilitate mounting hook members at each end in a hole defined therethrough. The thicker cross section prevents the hook member from shearing out through the strap while under tension loads induced by reaction between the strap, bag and floor or frame.

The hook members employed are preferably constructed from a circular steel bar and formed into an "S" shape having generous radii to insure structural integrity. In this manner, stress concentrations are eliminated which could lead to inadvertent hook failure under repeated stress. The hook member installed at one end of the strap may be releasably secured to a mounting provision such as a heavy duty eyelet or hook in the floor, or the frame beneath the supported bag. In an alternative embodiment, the hook member is configured for rotation about the longitudinal axis thereof, such that the strap may freely rotate if the bag spins while in use.

The hook member at the opposite end of the strap is releasably secured to a specially designed suction cup. The cup is a molded generally resilient member having a concave first side and a convex second side. The concave first side provides a bonding surface which may be rigidly attached to the bottom end of the bag by means of an adhesive such as "Superglue" or its equivalent. The convex second side has integrally molded means for securing a hook member thereto. The means for securing comprise a protrusion extending outward from the convex second side which is defined by four parallel sides which terminate in a half cylindrical outer boundary normal to a pair of parallel sides and blending into the other parallel sides. A hole extending through the protrusion is collinearly disposed on the longitudinal axis of the half cylindrical surface through which the curved portion of the hook member may be retained. The geometry of this protrusion provides a firm connection between the strap and the lower bag surface.

In accordance with the present invention, it is an object thereof to provide a spotter strap apparatus for eliminating the swing of a hangingly mounted heavy bag thereby.

It is another object of the present invention to provide a spotter strap apparatus which may be releasably attached to a hangingly mounted heavy bag, and to the floor or frame below.

In accordance with these and other objects which will become apparent hereinafter, the instant invention will now be described with particular reference to the accompanying drawings.

DETAILED DESCRIPTION OF THE PREFERRED EMBODIMENT

Figure 1:
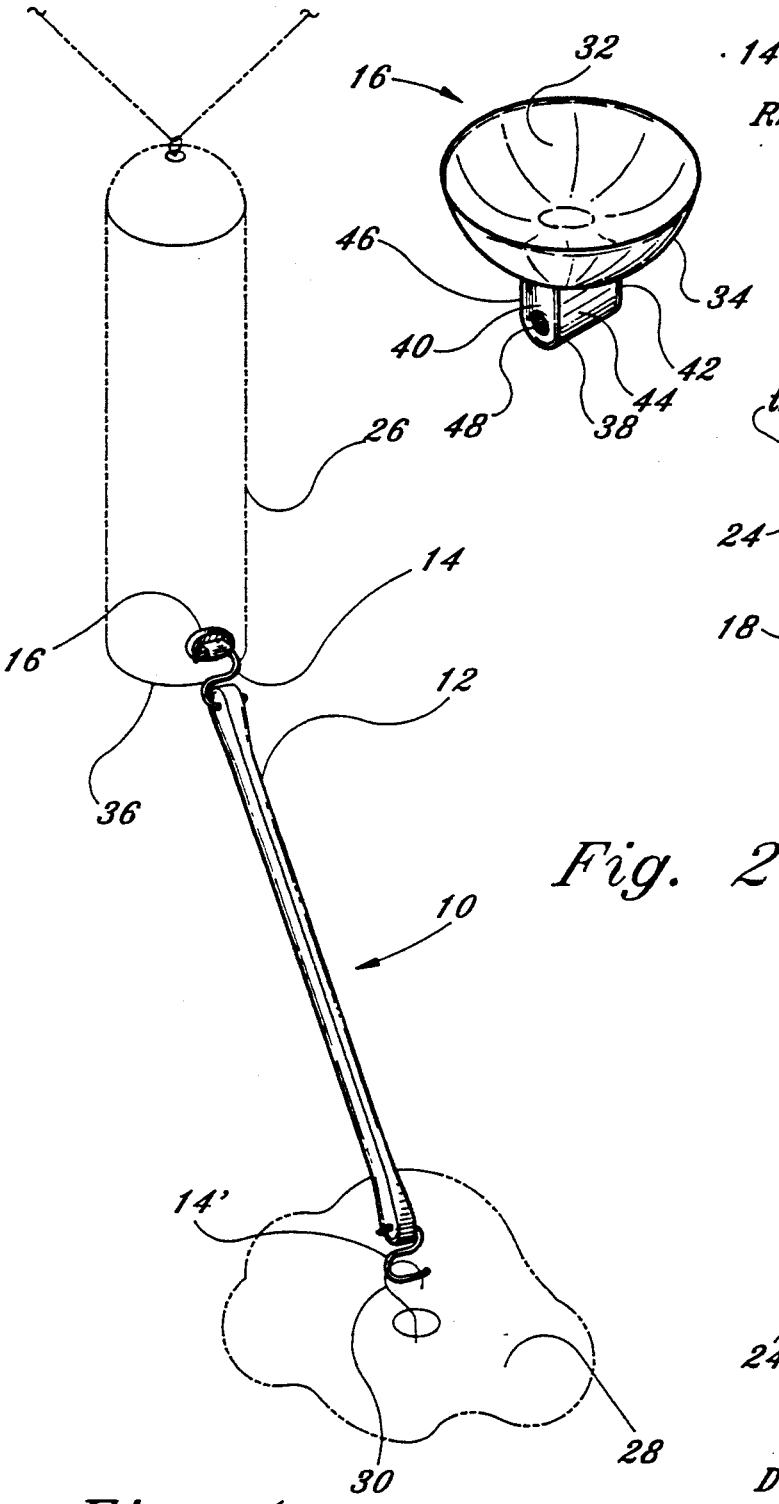
FIG. 1 is an assembly view of the spotter strap assembly attached to a heavy bag and the floor.

With reference to the several views of the drawings, there is depicted a spotter strap assembly characterized generally by the reference numeral 10 comprising a strap 12, first hook member 14, second hook member 14', and cup 16.

Strap 12 is a resilient member preferably fabricated from elastomeric material having an elongated body portion 18, which terminates in divergent first and second ends 20 and 22 respectively. In the preferred embodiment described herein, the section profile of body portion 18 is rectangular as defined by T & T2, to facilitate molding strap 12 by an injection molded process, however, body portion 18 may be constructed having alternate section profiles within the scope of the invention.

Figure 2:
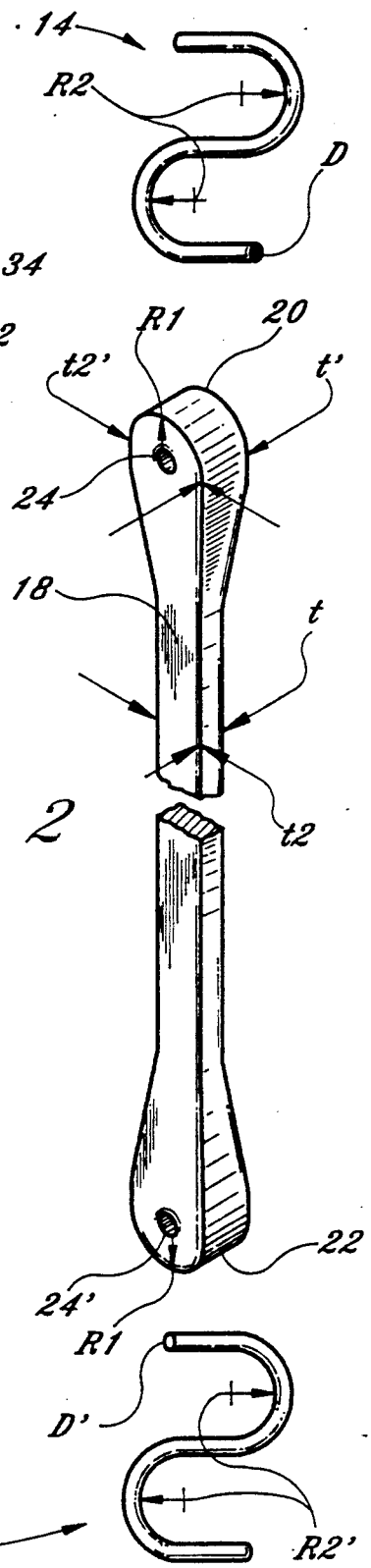
FIG. 2 is an exploded isometric view of the spotter strap components.

Ends 20 and 22 incorporate a larger section profile defined by T' and T2', which tapers divergently from body portion 18 so as to provide a greater bearing area for mounting hook members 14 and 14' through holes 24 and 24' respectively defined therethrough. In this manner, the larger section profile of ends 20 and 22 prevents hook members 14 and 14' from shearing through the strap 12 material when strap 12 is loaded in tension by reacting bag swing loads. Ends 20 and 22 may terminate in the outer surface defined by radius R1 to provide a smoother appearance as shown in FIG. 2.

Each end 20 and 22 has hook members 14 and 14' respectively attached thereto as described above to permit releasable attachment to heavy bag 26, and a floor or frame surface denoted generally as reference numeral 28. It is necessary that some means of attachment such as a hook or eyelet 30 be provided in the floor or on the frame 28. Hook members 14 and 14' are identical and fabricated preferably from round steel bar having a nominal diameter D which is formed into an "S" shape having generous radii R to eliminate an potential stress concentrations which could lead to premature hook failure.

Figure 3:
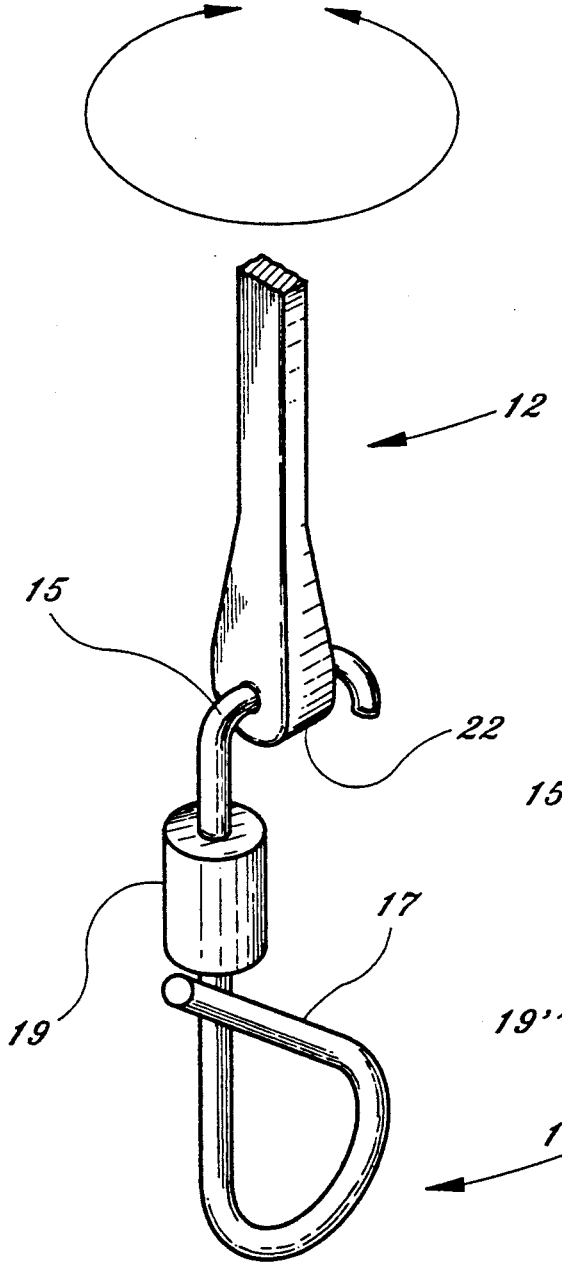
FIG. 3 is an isometric view of an alternate embodiment of the hook member.
Figure 4:
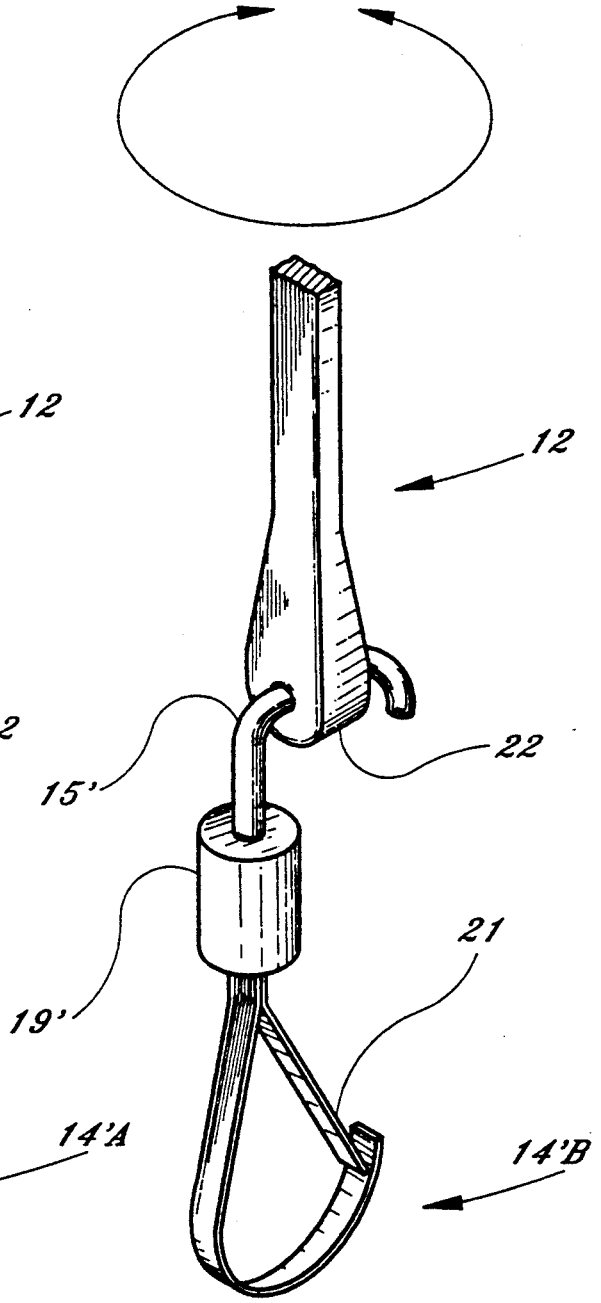
FIG. 4 is an isometric view of an alternate embodiment of the hook member.

In the alternative embodiment depicted in FIGS. 3 and 4, a swivel hook 14'A and swivel clip 14'B are respectively disclosed. The swivel hook 14'A in FIG. 3 is comprised of a first hook portion 15, a second hook portion 17, and swivel means 19. Swivel means 19 are rotatably associated with first hook portion 15 and are non-rotatably connected to second hook portion 17 such that first hook portion 15, attached strap 12, and bag 26 may pivot freely when rotational motion is imparted to bag 26.

FIG. 4 illustrates yet another embodiment of the instant invention, swivel clip 14'B, comprised of first hook portion 15', clip assembly 21, and swivel means 19', which facilitates the independent rotation of bag 26 and attached strap 12 when rotational motion is imparted to bag 26. First hook portion 15' is rotatably connected to swivel means 19 ', while clip assembly 21 is non-rotatably associated therewith.

Hook member 14, which is installed on first end 20 at strap 12, is releasably secured to a specially designed suction cup 16. Cup 16 is a molded, generally resilient member preferably fabricated from an elastomeric material, having a concave first side 32, and a convex second side 34. Concave first side 32 provides a bonding surface which may be rigidly secured to bottom end 36 of bag 26, by means of an adhesive such as "Superglue" or its equivalent. Integrally molded into convex second side 34 and protruding outward therefrom, is a means for securing hook member 14 thereto defined by four parallel sides which terminate and have cylindrical outer boundary 38 normal to a pair of first parallel sides 40 and 42, and blending into a second pair of parallel sides 44 and 46. Sides 40 and 42 have a hole 48 defined therebetween, disposed collinear with the central axis of half cylinder outer boundary 38 for retaining first hook member 14 therein. If desired, the means for attaching first hook member 14 to cup 16 may be designed with alternate geometry such as a molded ring within the scope of the invention.

Spotter strap 10 may be easily used with a variety of heavy bags 26 which are hangingly suspended on a frame as schematically depicted in FIG. 1. Cup 16 is bonded to bottom end 36 of bag 26 and strap 12 is releasably attached thereto by first hook member 14. Strap 12 is stretched so that second hook member 14' may be releasably secured to means for attaching 30 and floor or frame 28. In this manner, spotter strap 10 will prevent bag 26 from swinging back and forth when employed as a training medium for boxers by absorbing bag inertia in the elastic stretch of strap 12. When the user desires that the bag swing freely during training, he or she simply disconnects second hook 14' from means for attaching 30, or first hook 14 from suction cup 16, by pulling slightly on strap 12 so that it may stretch sufficiently to provide enough slack to enable the user to freely dislodge either hook member.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A spotter apparatus for restricting the dynamic motion of a heavy bag having a top end and a bottom end, when said bag is hangingly supported on a frame at said top end above a reference plane surface, comprising:

first and second hook members;

a resilient cup having a concave surface on its first side and a convex outer surface on its second side, said concave surface being rigidly securable to said heavy bag bottom end, said convex outer surface having means for securing said first hook member thereto, said means for securing including a protrusion extending outwardly from, and integral with, said convex outer surface, said protrusion having an aperture therethrough, defining a central axis means for receiving said hook therethrough, whereby said aperture extends through said central axis of said protrusion; and a stretchable strap member having first and second ends when said strap first end is attached to said cup by said first hook member, said strap second end is attached to said reference plane surface by said second hook member.

2. The spotter apparatus recited in claim 1, wherein said protrusion is defined by a pair of first parallel sides terminating in a radial edge which forms a half cylindrical surface therebetween intersecting a pair of second parallel sides perpendicular to said first parallel sides, said first parallel sides defining said aperture therethrough coincidentally disposed with said half cylinder's longitudinal axis, whereby said aperture extends through the longitudinal axis of said protrusion.

3. The spotter apparatus recited in claim 1, wherein said first and second hook members have an "S" profile and are cylindrical in cross section.

4. The spotter apparatus recited in claim 1, wherein said cup is fabricated from elastomeric material

5. The spotter apparatus recited in claim 1, wherein said cup concave surface is rigidly securable to said heavy bag bottom end with adhesive.

6. The spotter apparatus recited in claim 1, wherein said strap member is fabricated from elastomeric material, said strap member having a flat center portion of a nominal thickness diverging into a greater thickness than said flat center portion at said first and second ends.

7. The spotter apparatus recited in claim 1, wherein said second hook member is adapted for rotation about the longitudinal axis thereof.

8. The spotter apparatus recited in claim 7, wherein said hook member further comprises:

a first upper hook member, swivel means for permitting relative rotation of said first upper hook member therewith, rotatably connectable thereto, and a second lower hook member non-rotatably associated with said swivel means, whereby said heavy bag and strap member are free to rotate relative to said reference plane surface.

9. The spotter apparatus recited in claim 7, wherein said hook member further comprises:

a first upper hook member, swivel means for permitting relative rotation of said first upper hook member therewith, rotatably connectable thereto, and a spring clip assembly non-rotatably associated with said swivel means.

10. A spotter apparatus for restricting the dynamic motion of a heavy bag having a top and bottom end, when said bag is hangingly supported on a frame at said top end above a reference plane surface, comprising:

first and second hook members having an "S" profile, said first and second hook members having a cylindrical cross section;

an elastomeric cup having a concave surface on its first side and a convex outer surface on its second side, said concave surface being rigidly securable to said heavy bag bottom end with adhesive, said convex outer surface having means for securing said first hook member thereto, said means for securing comprising a protrusion extending outward from, and integral with, said elastomeric cup convex outer surface, said protrusion defined by a pair of first parallel sides terminating in a radial edge which forms a half cylindrical surface therebetween intersecting a pair of second parallel sides perpendicular to said first parallel sides defining an aperture therethrough coincidentally disposed with said half cylinder's longitudinal axis; and a stretchable elastomeric strap member having a flat center portion of a nominal thickness between divergent first and second ends of greater thickness, said first and second ends defining apertures therethrough for securing said first and second hook members respectively therein, whereby said elastomeric strap restricts said dynamic motion of said heavy bag when said strap first end is attached to said elastomeric cup by said first hook member, and said strap second end is attached to said reference plane surface by said second hook member.

11. The spotter apparatus recited in claim 7, wherein said second hook member is adapted for rotation about the longitudinal axis thereof.

12. The spotter apparatus recited in claim 11, wherein said hook member further comprises:

a first upper hook member, swivel means for permitting relative rotation of said first upper hook member therewith, rotatably connectable thereto, and a second lower hook member non-rotatably associated with said swivel means, whereby said heavy bag and strap member are free to rotate relative to said reference plane surface.

13. The spotter apparatus recited in claim 11, wherein said hook member further comprises:

a first upper hook member, swivel means for permitting relative rotation of said first upper hook member therewith, rotatably connectable thereto, and a spring clip assembly non-rotatably associated with said swivel means.

* * * * *